US008297530B2

(12) United States Patent
Filicicchia et al.

(10) Patent No.: US 8,297,530 B2
(45) Date of Patent: Oct. 30, 2012

(54) ULTRASONIC ATOMIZING NOZZLE WITH VARIABLE FAN-SPRAY FEATURE

(75) Inventors: Daniel J. Filicicchia, Londonderry, NH (US); David C. Huffman, Merrimack, NH (US); Michel R. Thenin, Amherst, NH (US)

(73) Assignee: Spraying Systems Co., Wheaton, IL (US)

( * ) Notice: Subject to any disclaimer, the term of this patent is extended or adjusted under 35 U.S.C. 154(b) by 371 days.

(21) Appl. No.: 12/678,779

(22) PCT Filed: Sep. 19, 2008

(86) PCT No.: PCT/US2008/077096

§ 371 (c)(1),
(2), (4) Date: Mar. 22, 2010

(87) PCT Pub. No.: WO2009/039424

PCT Pub. Date: Mar. 26, 2009

(65) Prior Publication Data

US 2010/0213273 A1 Aug. 26, 2010

Related U.S. Application Data

(60) Provisional application No. 60/994,817, filed on Sep. 21, 2007.

(51) Int. Cl.
*B05B 1/08* (2006.01)

(52) U.S. Cl. ..... 239/102.1; 239/296; 239/422; 239/423; 239/424.5

(58) Field of Classification Search ..... 239/102.1, 239/102.2, 290, 296, 421, 422–424.5
See application file for complete search history.

(56) References Cited

U.S. PATENT DOCUMENTS

| | | | | |
|---|---|---|---|---|
| 3,904,347 | A * | 9/1975 | Rokudo et al. | 431/1 |
| 5,110,286 | A * | 5/1992 | Gaysert et al. | 431/208 |
| 5,186,389 | A * | 2/1993 | Shibano | 239/102.2 |
| 5,435,491 | A * | 7/1995 | Sakuma | 239/296 |
| 5,613,637 | A | 3/1997 | Schmon | |
| 5,836,514 | A * | 11/1998 | Handfield | 239/14.2 |
| 7,029,513 | B2 | 4/2006 | Gardner et al. | |

FOREIGN PATENT DOCUMENTS

EP 0 068 097 A1 1/1983

OTHER PUBLICATIONS

Supplementary European Search Report in corresponding European Application No. 08831594, mailed Apr. 26, 2011.

* cited by examiner

*Primary Examiner* — Christopher Kim
(74) *Attorney, Agent, or Firm* — Leydig, Voit & Mayer, Ltd.

(57) ABSTRACT

A spray nozzle assembly that utilizes ultrasonic atomization techniques to atomize a liquid into a cloud of small or fine droplets is disclosed. The nozzle assembly also can use various air or gas atomizing technologies to propel the generally directionless droplet cloud toward a surface or substrate to be coated. The propelled droplet cloud may at this state have a conical or cone-shaped spray pattern. Additional air or gas atomizing technologies can be utilized to shape the propelled droplet cloud into a flattened fan-shaped spray pattern that can be usable in various industrial applications. The shape of the spray pattern and the distribution of droplets within the pattern can be adjusted by manipulation of the gas pressure used in gas atomization.

10 Claims, 3 Drawing Sheets

ULTRASONIC ATOMIZING NOZZLE WITH VARIABLE FAN-SPRAY FEATURE

CROSS-REFERENCE TO RELATED APPLICATIONS

This patent application claims the benefit of U.S. Provisional Patent Application No. 60/994,817, filed Sep. 21, 2007, which is incorporated by reference.

BACKGROUND OF THE INVENTION

It is known to use spray nozzles to produce a spray for a wide variety of applications including, for example, coating a surface with a liquid. Typically, in a spray nozzle coating application, liquid is atomized by the spray nozzle into a mist or spray of droplets which is deposited onto a surface or substrate to be coated. The actual droplet size of the atomized liquid and the shape or pattern of the spray discharge from the nozzle can be selected depending upon a variety of factors including the size of the object being coated and the liquid being atomized.

One known technique for atomizing liquids into droplets is to direct pressurized gas such as air into a liquid and thereby mechanically break the liquid down into droplets. In such gas atomization techniques, it can be difficult to control and/or minimize the size and consistency of the droplets. Another known type of spray nozzle is an ultrasonic atomizing nozzle assembly that utilizes ultrasonic energy to atomize a liquid into a cloud of small, fine droplets which is almost smoke-like in consistency. The distribution of droplets within the cloud produced by an ultrasonic atomizer also tend to be advantageously uniform. However, the variety of spray patterns that can be discharged from ultrasonic atomizing nozzles tend to be limited, typically to a conical or cone-shaped pattern. Moreover, because the fine droplets have little mass, they may drift or become dispersed shortly after discharge from the spray nozzle. Because spray patterns made up of such fine droplets are difficult to shape and control, their use in many industrial applications is disadvantageously affected.

OBJECTS AND SUMMARY OF THE INVENTION

It is an object of the invention to produce a liquid spray of small, fine, uniform droplets in a controlled spray pattern for dispersal upon a surface or substrate.

It is another object of the invention to provide a spray nozzle assembly utilizing an ultrasonic atomizer that enables adjustment of the shape of the spray pattern and control over the distribution of the atomized droplets within the pattern.

It is a further object of the invention to provide a spray nozzle assembly operable for shaping an ultrasonically atomized droplet cloud into a fan spray pattern usable in various industrial applications such as screen coatings for visual monitors.

The foregoing objects can be accomplished by the inventive spray nozzle assembly which utilizes ultrasonic atomization to atomize a liquid into a fine droplet cloud and can also utilize air or gas to shape the spray pattern into, for example, a fan spray pattern and/or to propel the pattern onto a surface or target. The shape of the spray pattern and the distribution of droplets within the pattern further can be selectively adjusted by manipulation of the air or gas pressure.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE EMBODIMENTS

Figure 1:
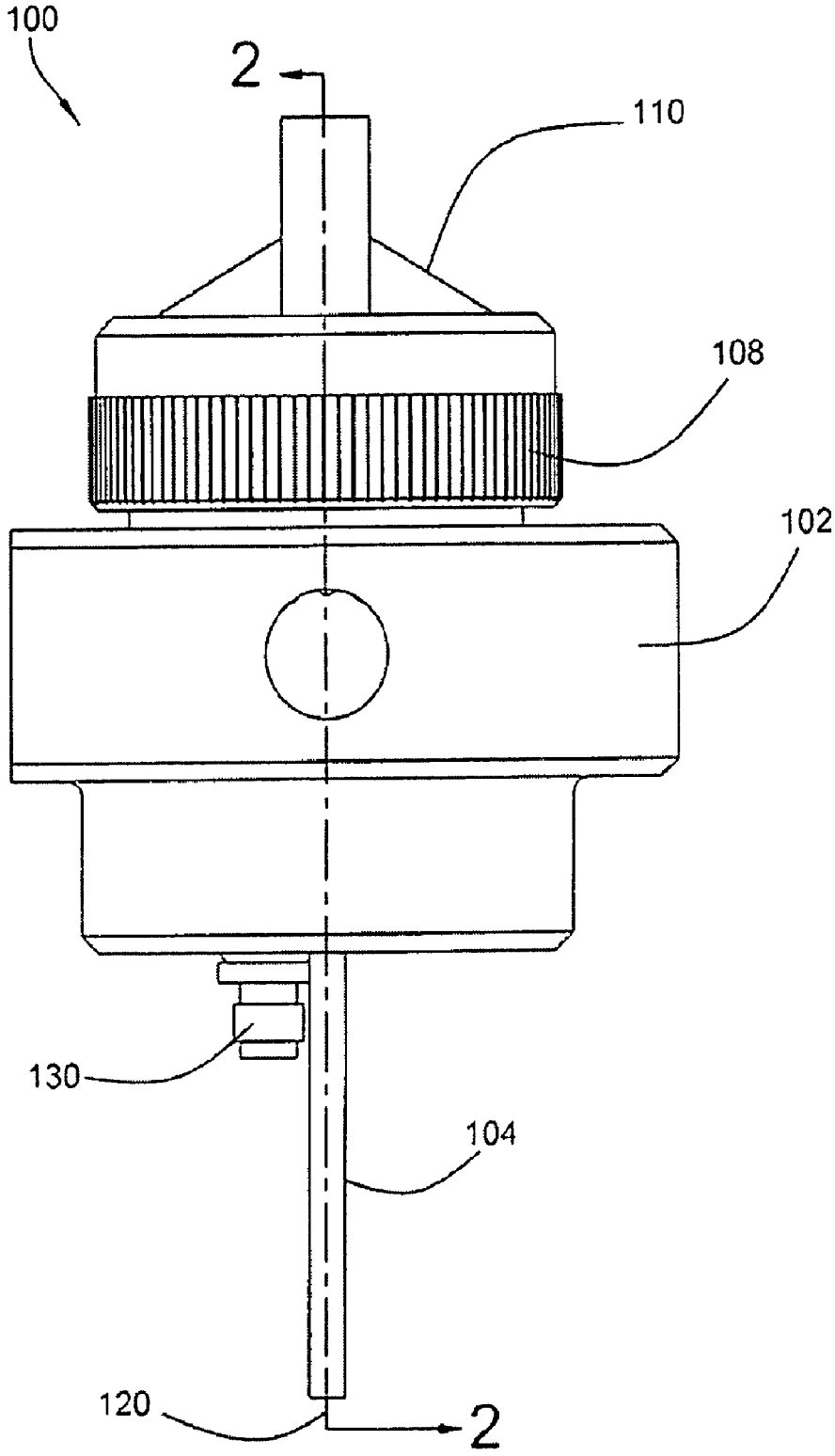
FIG. 1 is a side elevational view of a spray nozzle assembly in accordance with the invention for producing a shaped spray pattern of liquid droplets.

Now referring to the drawings, wherein like reference numbers refer to like features, there is illustrated in FIG. 1 a nozzle assembly 100 for producing a liquid spray pattern and which utilizes both ultrasonic and gas atomization techniques. The nozzle assembly 100 includes a nozzle body 102 which may have a stepped cylindrical shape and from which extends in a rearward direction a liquid inlet tube 104 by which liquid may be taken into the nozzle assembly. Mounted to the front of the nozzle body 102 can be an air cap 110 from which the liquid can be forwardly discharged in the form of an atomized spray of fine droplets or particles. It should be noted that directional terminology such as "forward" and "reward" are for reference purposes only and are not otherwise intended to limit the nozzle assembly in any way. To mount the air cap 110 to the nozzle body 102, in the illustrated embodiment an annular threaded retention nut 108 is threaded onto the nozzle body so as to retentively clamp the air cap thereto.

Figure 2:
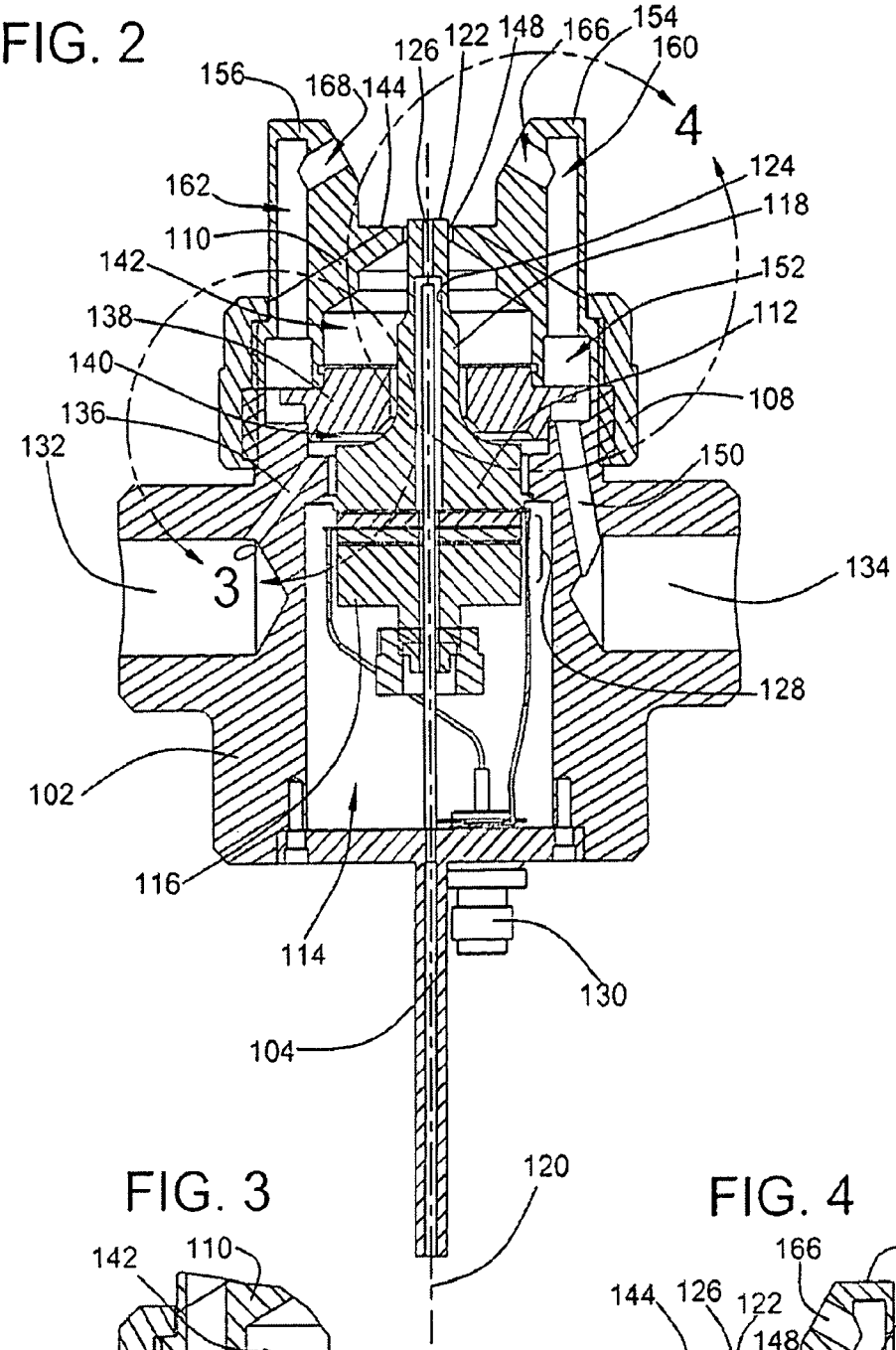
FIG. 2 is a cross-sectional view of the illustrated spray nozzle assembly, taken along lines A-A of FIG. 1.

To ultrasonically atomize the liquid, as shown in FIG. 2, the nozzle assembly 100 also includes an ultrasonic atomizer 112 received within a central bore 114 that is disposed into the nozzle body 102. The ultrasonic atomizer 112 includes an ultrasonic driver 116 from which extends in the forward direction a rod-like cannular atomizer stem 118. In the illustrated embodiment, both the ultrasonic driver and the atomizer stem can be cylindrical in shape, with the ultrasonic driver having a larger diameter than the atomizer stem. For references purposes, the extended cannular atomizer stem 118 can delineate a centrally located axis line 120. At its axially forward tip or end, the atomizer stem 118 terminates in an atomizing surface 122. To direct the liquid to be atomized to the atomizing surface 122, the cannular atomizing stem 118 forms a liquid feed passage 124 that is disposed through the atomizing surface to provide a liquid exit orifice 126. The liquid passage 124 extends along the axis line 120 and is in fluid communication with the liquid inlet tube 104 of the nozzle body 102. The ultrasonic atomizer can be comprised of a suitable material such as titanium.

To generate the ultrasonic vibrations for vibrating the atomizing surface 122, the ultrasonic driver 116 can include a plurality of adjacently stacked piezoelectric transducer plates or discs 128. The transducer discs 128 are electrically coupled to an electronic generator via an electrical communication port 130 extending from the rear of the nozzle body 102. Moreover, the transducer discs 128 can be electrically coupled so that each disc has an opposite or reverse polarity of an immediately adjacent disc. When an electrical charge is coupled to the stack of piezoelectric discs 128, the discs expand and contract against each other thereby causing the ultrasonic driver 116 to vibrate. The vibrations are transferred to the atomizing surface 122 via the atomizer stem 118, causing any liquid present at the atomizing surface to discharge into a cloud of very fine droplets or particles.

In accordance with an aspect of the invention, to shape, propel and control the liquid droplet cloud discharging from the ultrasonic atomizer, a plurality of pressurized air discharge orifices are provided. To that end, the nozzle body 102 also includes a first gas inlet port 132 that can communicate with a pressurized gas source and a second gas inlet port 134 that can likewise communicate with another pressurized gas source. The first and second gas inlet ports 132, 134 can be diametrically opposed and disposed radially inward into the stepped cylindrical shape of the nozzle body 102. Intercommunicating channels and cavities in the nozzle body 102 and the forwardly mounted air cap 110 redirect the pressurized gases from the first and second gas inlet ports 132, 134 to form and propel the spray pattern from the nozzle assembly 100. As will be appreciated, any suitable gas or air can be selected depending upon the particular spraying application in which the nozzle assembly is utilized.

Figure 3:
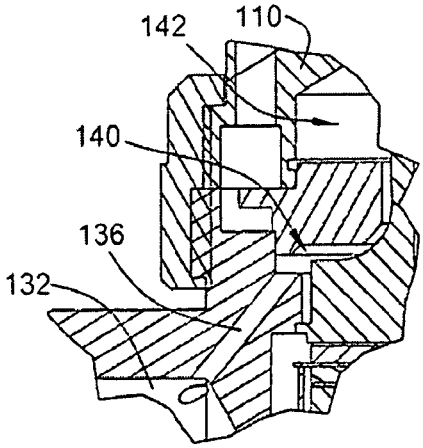
FIG. 3 is a detailed view of the area indicated by circle B-B of FIG. 2 showing the gas flow passageways disposed through the nozzle assembly.

As illustrated in FIGS. 2 and 3, to direct gas from the first inlet port 132 to the atomizing surface 122 of the ultrasonic atomizer 112, a first air passageway 136 is disposed forwardly through the nozzle body 102 toward the air cap 110. Set between the nozzle body 102 and the air cap 110 can be an annular inter-spacer ring 138. As illustrated, the annular inter-spacer ring 138 is set about the ultrasonic atomizer 112 such that the atomizer stem 118 extends through the center of the annular inter-spacer ring. Moreover, the inner annular surface of the annular inter-spacer ring 138 is offset from the ultrasonic atomizer 112 so that an inner air gap 140 is formed between the two components. The inner air gap 140 establishes communication between the first air passageway 136 and the rearward axial face of the air cap 110.

Figure 4:
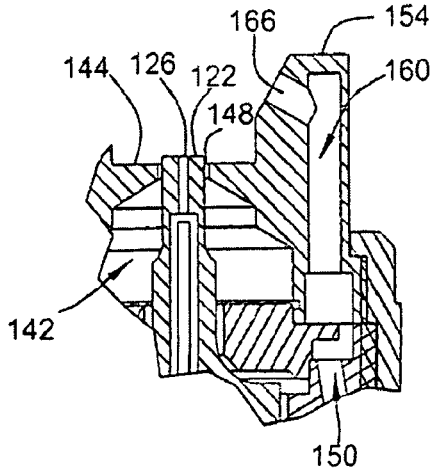
FIG. 4 is a detailed view taken of the area indicated by circle C-C of FIG. 2 showing the atomization tip of the ultrasonic atomizer and a jet orifice for discharging pressurized gas.

Referring to FIGS. 2 and 4, there can be disposed through the rearward face of the air cap 110 along the axis line 120 an air chamber 142 which, as shown in the illustrated embodiment, tapers radially inward from the rearward face to an axially forward face 144 of the air cap. The tapering air chamber 142 can be formed by one or more axially centralized countersinks. The air chamber 142 is disposed through the axially forward face 144 of the air cap 110 to form a circular, axially central discharge orifice 148. When the air cap 110 is mounted to the nozzle body 102, the atomizer stem 118 of the ultrasonic atomizer 112 can be received through the air chamber 142 and the discharge orifice 148. Accordingly, the discharge orifice 148 should be slightly larger than the atomizer stem 122 to accommodate the later. Preferably, the tip of the atomizer stem 118 protrudes through the discharge orifice 148 so that the atomizing surface 122 is located slightly axially forward of the axially forward face 144 of the air cap. Because the cylindrical atomizer stem 118 is received through the larger circular discharge orifice 122, the discharge orifice has an annular shape. The gas chamber 142 and the discharge orifice 148 therefore communicate air from the first inner air gap 140 outward past the atomizing surface 122.

To direct gas from the second gas inlet port 134 of the nozzle body 102 to discharge from the air cap 110, referring to FIGS. 2 and 4, the nozzle body includes a second forwardly directed air passageway 150. The second air passageway 150 communicates with an outer annular air gap 152 formed between the inter-spacer ring 138 and the axially rearward face of the nozzle body 102. The outer annular air gap 152 can generally radially surround the inner annular air gap 140 and are preferably physically separated or sealed to prevent gas leakage therebetween.

The air cap 110 can also include ear-like first and second jet flanges 154, 156 which extend forwardly of the axially forward face 144 of the air cap. The first and second jet flanges 154, 156 are radially offset with respect to the axis line 120 and are diametrically opposed to each other about the axis line. To direct pressurized gas from the second inlet port 134 through the first and second jet flanges 154, 156, there are disposed through each jet flange a respective first and second, forwardly directed air channel 160, 162. Though the first and second air channels 160, 162 are physically separated, they can commonly communicate with the outer annular air gap 152 to receive air from the second gas inlet port 134 via the second air passageway 150.

At the distal or forward-most tips of the first and second jet flanges 154, 156, the first and second channels 160, 162 are disposed through the radially inward facing surface of the respective flanges to form diametrically opposed first and second jet orifices 166, 168. By reason of being located at the distal tips of the first and second jet flanges, the jet orifices 166, 168 are located axially forward of the annular-shaped discharge orifice 148. In addition to being directed radially inward, the first and second jet orifices 166, 168 can also be disposed at an angular relation with respect to the axis line 120 so that they can produce a forwardly directed discharge. As will be appreciated from FIG. 2, the first and second jet orifices 166, 168 are arranged such that impinging jets intersect proximate the axis line 120.

In operation, the liquid to be sprayed is fed into the liquid feed passage 124 through the cannular atomizer stem 118 to the atomizing surface 122. To assist in forcing the liquid to the atomizing surface 122, the liquid can be gravity fed or pressurized by a low-pressure pump. Liquid from the liquid feed passage 124 exits the liquid exit orifice 126 and can collect about the atomizing surface 122 by a capillary-like or wicking-like transfer action. The ultrasonic driver 116 can be electrically activated so that the piezoelectric discs 128 expand and contract to generate transverse or radial vibrations of the atomizer stem 118 and the atomizing surface 122. The vibrations experienced at the atomizing surface 122 can be at the frequency of about 60 kilohertz (kHz), although the frequency can be adjusted depending upon the liquid to be atomized or other factors. The transverse or radial vibration agitates the liquid within the liquid feed passage 124 and the liquid collected on the atomizing surface 122 such that the liquid is shaken from or separates from the atomizing surface in small, fine droplets. The size of the droplets can be on the order of about 5-60 microns, and may preferably range between about 8-20 microns. The droplets form a directionless cloud or plume generally proximate to the atomizing surface 122.

To propel the generally directionless droplet cloud forward, a pressurized stream of gas or air can be directed to the first gas inlet port 132. This forward-propelling gas stream is directed via the first air passageway 136 and the inner annular air gap 140 formed between the inter-spacer ring 138 and the ultrasonic atomizer 112 to the air chamber 142 disposed into the air cap 110. The pressurized, forward-propelling air stream exits the nozzle assembly 100 through the annularly shaped discharge orifice 148. The liquid droplet cloud present about the atomizing surface will become entrained with and carried forward generally along the axis line 120 by the forward-propelling air stream to form the liquid spray. As can be appreciated, imparting movement to the atomized droplet cloud in this manner will also reduce unintended dispersion or drift of the droplets. The pressure of the forward-propelling air stream can be varied to control the forward movement and velocity of the ultrasonically atomized liquid droplets. Because of the annular shape of the discharge orifice 148, the forward-propelled air stream with the entrained droplets at this position will generally have a cone or conical-like spray pattern.

Figure 5:
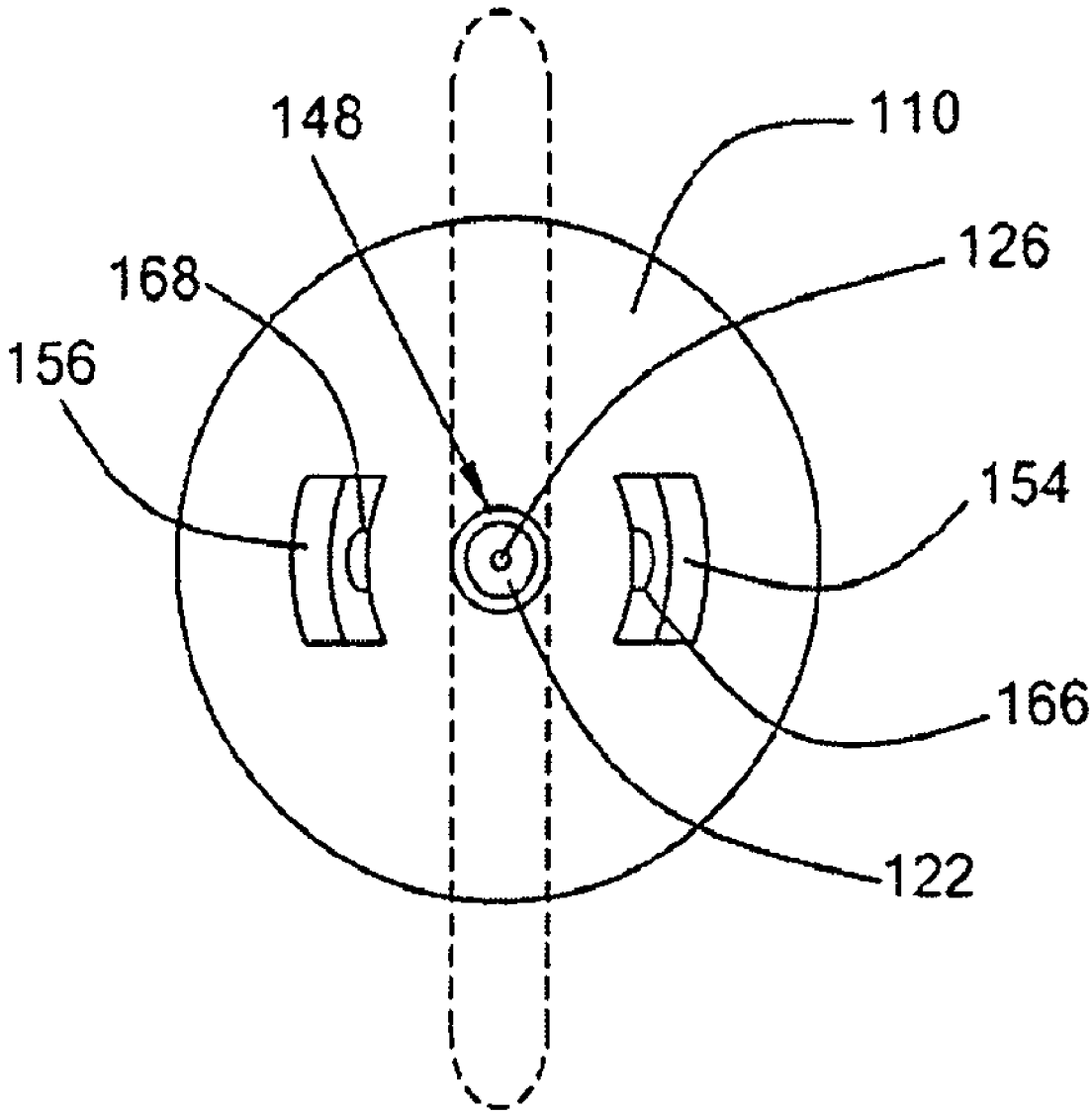
FIG. 5 is an end view of the downstream end of the illustrated spray nozzle assembly shown in FIG. 1.

To shape the liquid spray into a flattened, fan-like pattern, pressurized gas or air is delivered to the second gas inlet port 134. This fan-shaping gas stream is directed to the first and second jet flanges 154, 156 via the second air passageway 150, the outer annular air gap 152 and the first and second air channels 160, 162. The pressurized fan-shaping gas stream discharges from the diametrically opposing first and second jet orifices 166, 168 to impinge upon the forward-propelling gas stream carrying the liquid droplets and that are being directed between the first and second jet flanges 152, 154 generally along the axis line 120. Referring to FIG. 5, because of the opposing relation of the first and second jet orifices 166, 168, the impinging jets of the fan-shaping gas stream will tend to flatten the conically-shaped forward-propelling gas stream to form a generally two dimensional fan-shaped pattern illustrated by the dashed lines. The fan-shaped pattern is one of the more useful spray patterns used in industrial spray applications.

In an advantageous embodiment of the spray nozzle assembly 100, the pressurized gas being delivered to provide the forward-propelling gas stream and the fan-shaping gas stream can be manipulated to adjust the shape and distribution of droplets within the fan-shaped pattern. For example, increasing the pressure of the forward-propelling gas stream with respect to the pressure of the fan-shaping gas stream will tend to move more liquid droplets into the middle of the fan-shaped pattern. Decreasing the pressure of the forward-propelling gas stream with respect to the pressure of the fan-shaping gas stream will tend move more droplets to the outer edges of the fan-shaped spray pattern. Accordingly, the width, shape, and droplet distribution of the spray pattern can be adjusted to suit a particular spray application.

To enable such adjustment, it is desirable that the first and second gas inlet ports 132, 134 be in communication with separate pressurized gas sources or be controlled by an appropriate pressure regulator. The pressures used to supply the forward-propelling gas stream and the fan-shaping gas stream can be on the order of 1-3 PSI. Additionally, the channeling between first gas inlet port 132 and the annularly shaped discharge orifice 148 for the forward-propelling gas stream should remain physically separated from the channeling between the second gas inlet port 134 and the jet orifices 166, 168 so that leakage therebetween is minimized.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. An air assisted, ultrasonic atomizing nozzle assembly comprising:

an ultrasonic atomizer including a ultrasonic driver and a cannular atomizer stem extending from said driver, said stem terminating in an atomizing surface, and said cannular atomizer stem providing a liquid passage extending along an axis line for directing liquid to said atomizing surface;

a nozzle body including a cavity receiving said ultrasonic atomizer such that said atomizer stem extends axially from said nozzle body, said nozzle body further including a first gas inlet port and a second gas inlet port;

an air cap mounted axially forward of said nozzle body, said air cap including an air chamber and a discharge orifice through which said atomizer stem is received so that said atomizing surface is located axially forward of said discharge orifice, said discharge orifice and said atomizer stem forming an annular-shaped gap communicating with said first gas inlet port; and said air cap further including opposing first and respective second jet orifices each directed radially inward to impinge upon each other, said first and second jet orifices communicating with said second gas inlet port;

whereby, a forward-propelling gas stream introduced to said first gas inlet port can be directed to said atomizing surface via said annular-shaped discharge orifice to propel liquid droplets ultrasonically atomized at said atomizing surface; and whereby as fan-shaping gas stream introduced to the second gas inlet port can be directed to said first and second jet orifices to impinge upon the forwardly-propelled ultrasonically atomized liquid droplets.

2. The ultrasonic atomizing nozzle assembly of claim 1, wherein the pressure of said forward-propelling gas stream and the pressure of said fan-shaping gas stream are adjustable with respect to each other.

3. The ultrasonic atomizing nozzle assembly of claim 1, further comprising an inner air gap establishing communication between said first inlet port and said discharge orifice.

4. The atomizing nozzle assembly of claim 3, further comprising an outer air gap establishing communication between said second inlet port and said first and second jet orifices.

5. The ultrasonic atomizing nozzle assembly of claim 4, further comprising an inter-spacer ring located generally between said nozzle body and said air cap, said atomizer stem extending through said inter-spacer ring, said inter-spacer ring separating said inner air gap and said outer air gap.

6. The ultrasonic atomizing nozzle assembly of claim 5, wherein said inner air gap is formed between said atomizer stem and said inter-spacer ring and said outer air gap is formed between said nozzle body and said inter-spacer ring.

7. The ultrasonic atomizing nozzle assembly of claim 6, wherein said outer air gap surrounds said inner air gap.

8. The ultrasonic atomizing nozzle assembly of claim 1, wherein said first and second gas inlet ports are axially spaced from said discharge orifice and said first and second jet orifices.

9. The ultrasonic atomizing nozzle assembly of claim 1, wherein said first and second gas inlet ports are disposed radially into said nozzle body.

10. The ultrasonic atomizing nozzle assembly of claim 1, wherein the air cap includes first and second, radially offset, axially extending jet flanges, said first and second jet orifices disposed in respective first and second jet flanges.

* * * * *